United States Patent [19]

Hodson et al.

[11] Patent Number: 4,605,021

[45] Date of Patent: Aug. 12, 1986

[54] SELF-TENSIONING HAIR WAVING ROD

[75] Inventors: Homer J. Hodson, Homewood; Glenn A. Shurney, Chicago; Eric E. Hartman, Lisle, all of Ill.

[73] Assignee: Alberto-Culver Company, Melrose Park, Ill.

[21] Appl. No.: 640,463

[22] Filed: Aug. 13, 1984

[51] Int. Cl.[4] ..... A45D 2/12

[52] U.S. Cl. ..... 132/33 R; 132/39; 132/41 R; 132/42 R; 132/43 R

[58] Field of Search ..... 132/33 R, 39, 40, 41 R, 132/41 A, 41 B, 41 C, 42 R, 42 A, 43 R, 43 A, 44

[56] References Cited

U.S. PATENT DOCUMENTS 2,582,550 1/1952 Madore ..... 132/33 R
2,747,585 5/1956 Allen ..... 132/42 R
2,941,534 6/1960 Otto et al. ..... 132/41 R
3,003,505 10/1961 Otto et al. ..... 132/7
3,200,826 8/1965 Solomon ..... 132/41 R

FOREIGN PATENT DOCUMENTS 633955 12/1949 United Kingdom ..... 132/36.2 R

*Primary Examiner*—John J. Wilson

[57] ABSTRACT

The self-tensioning hair waving rod includes a cylindrical sponge body and retainer means for holding a strand of hair wrapped around the sponge body. The sponge body is formed of a hydrophilic polymer which expands from a dry condition on application of water to increase its volume by at least 50%. This expansion tightens the wrapped hair strand and draws it into close proximity to the outer surface of the sponge body. This hair waving rod and its method of use are adapted for home permanents.

6 Claims, 15 Drawing Figures

FIG. 6
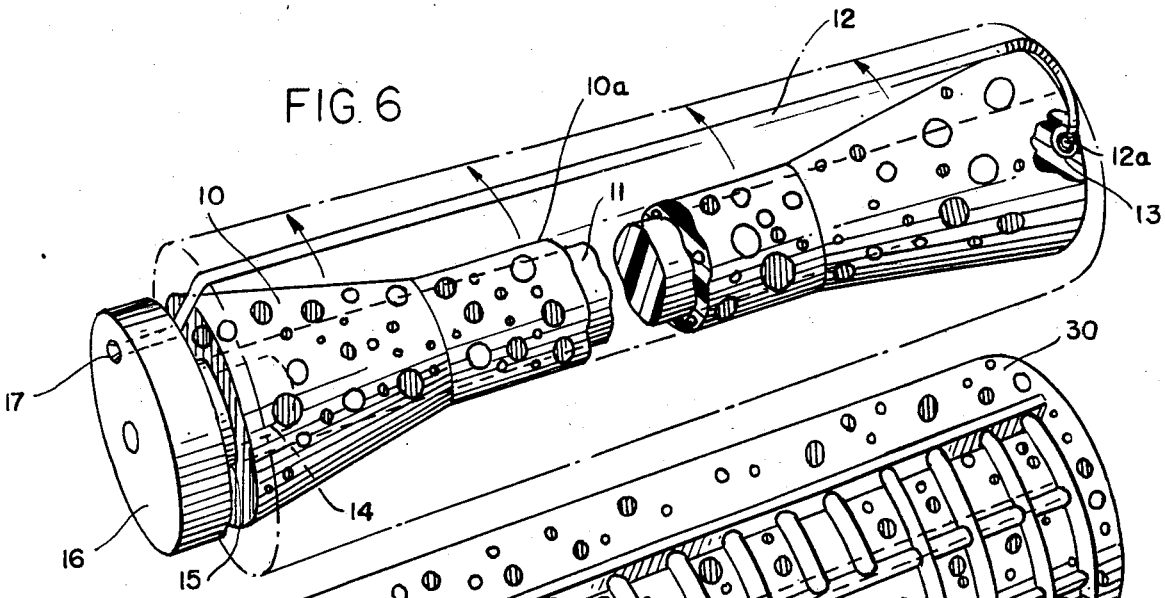
FIG. 7
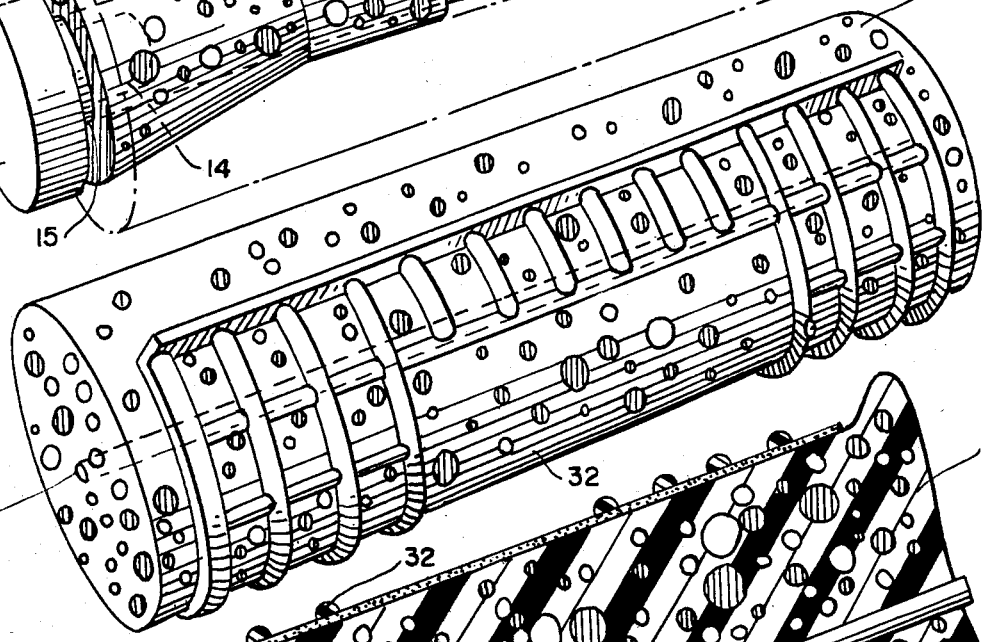
FIG. 8
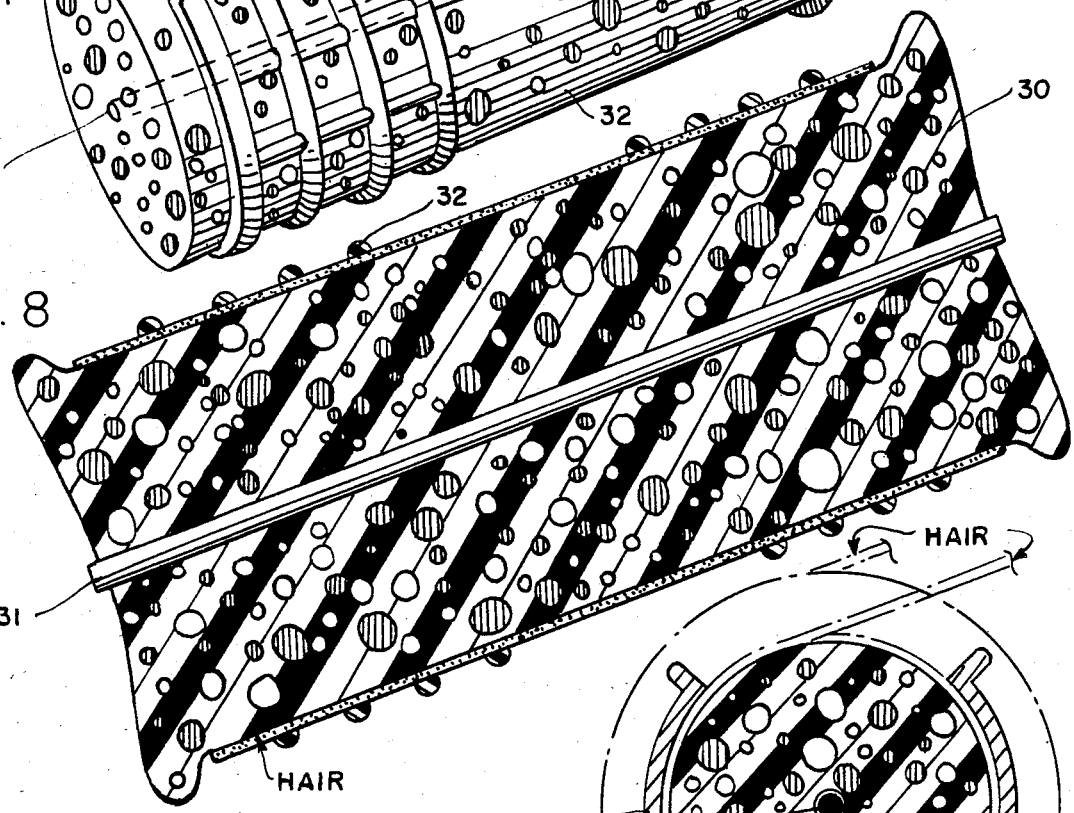
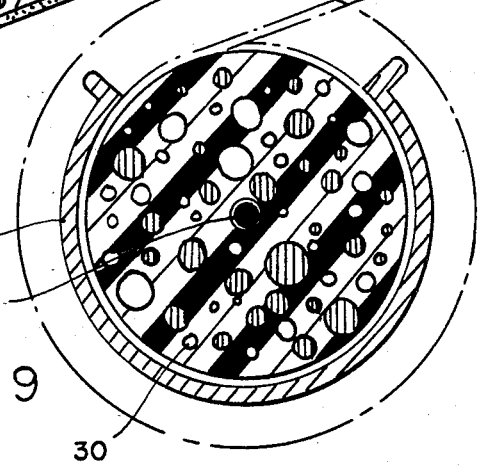
FIG. 9

SELF-TENSIONING HAIR WAVING ROD

FIELD OF INVENTION, BACKGROUND AND PRIOR ART

The field of this invention is waving rods or similar hair curler devices for use in curling human hair, especially in connection with home-type permanents. This invention also relates to methods of using waving rods.

Although there is a considerable variation in specific designs of hair waving rods for use in connection with home permanents, the basic construction of such devices are generally similar. They include a cylindrical or tubular hair support member about which the hair is wrapped. Associated with the support member is a retainer means, such as a clip or clamp, which functions to hold the wrapped strand of hair on the support. Some of the commercial hair waving rods are formed entirely of molded plastics, while others employ a combination of plastic components and body members formed of adsorbent sponge materials. In one commercial construction, a tubular sponge member has a plastic coated copper wire extending axially therethrough. After the hair is wrapped around the central portion of the sponge body, the outer end portions of the rod are folded and crimped inwardly to hold the wrapped hair.

With most of the currently used waving rods, a waving solution is applied to the rolled strands of hair, viz. by squeezing or daubing. It has been proposed to provide other means for transferring the waving composition to the hair which permits the composition to be initially contacted with the hair in dry condition. This would permit the application of water instead of a waving composition. For example, so-called "waving end papers" have been used for this purpose.

Prior patents have described waving rods or hair curlers employing porous sponge members which are impregnated with a waving solution, and which provide means for transferring a waving solution from the interior of the rod or curler to the wrapped hair. Illustrative of this prior art are U.S. Pat. Nos. 2,747,585, 2,941,534, 3,003,505 and 3,200,826. As far as is known, such constructions have not met with much practical use or commercial acceptance.

In the design and use of prior art waving rods and hair curlers, it has been difficult to obtain a tight wrap of the hair around the device. This can result in the resultant wave having a lesser degree of curl or tightness than desired by the user. Another problem with respect to the use of prior art devices is that the application of the waving solution is a messy procedure. It is difficult to confine the solution to the portion of the hair wrapped around the curler. When other expedients have been tried such as the use of end papers containing the waving composition in dry form, the transfer of the waving composition to the hair following the application of water has been incomplete and uneven. Prior to the present invention no solution has been provided to these inter-related problems. It has been desired to provide more convenient and more effective means for the home permanent waving of hair.

SUMMARY OF INVENTION

The present invention utilizes an expandable sponge body as the principal component of the waving rod. This sponge body in dry condition has a much smaller diameter than in wet condition. The strand of hair is wrapped around the dry sponge, and secured thereon by a suitable retainer. Water is then applied to cause the sponge to expand by a volumetric amount in the range of at least 50 to 250% of the dry volume. The wrapped hair is thereby tightened around the sponge, providing a self-tensioning action. Preferably the sponge body contains a water-soluble waving composition. As the sponge becomes wet and expands, the waving composition is also solubilized, and moves from the sponge into the wrapped hair. Since the innermost turn of the hair is brought into close proximity with the outer surface of the sponge body, a more uniform and thorough transfer of the waving solution to the hair can be obtained. Where the hair is wrapped around the central portion of the sponge body, the projecting outer end portions of the sponge can expand outwardly further than the wrapped portion, thereby providing a constriction or squeezing effect which further contributes to the transfer of the waving solution from the sponge to the wrapped hair. The result is an easier, quicker waver, with less messy application, and the achievement of a tighter wave. Special waving effects can also be obtained such as pattern waving.

THE DRAWINGS

The accompanying drawings illustrate embodiments of the present invention, comprising self-tensioning hair waving rods which include water-absorbing sponge bodies that are capable of a large amount of expansion on the application of water.

FIGS. 1 to 5 illustrate a first embodiment, FIGS. 1, 2, and 4 being perspective views illustrating the waving rod and its use, and FIGS. 3 and 5 sectional views, taken, respectively, on line 3—3 of FIG. 2 and line 5—5 of FIG. 4.

FIG. 6 is a perspective view of a modification of the embodiment of the preceding figures.

FIGS. 7–9 illustrate a further embodiment, FIG. 7 being a perspective view, FIG. 8 a longitudinal sectional view, and FIG. 9 an end view.

Figure 10:
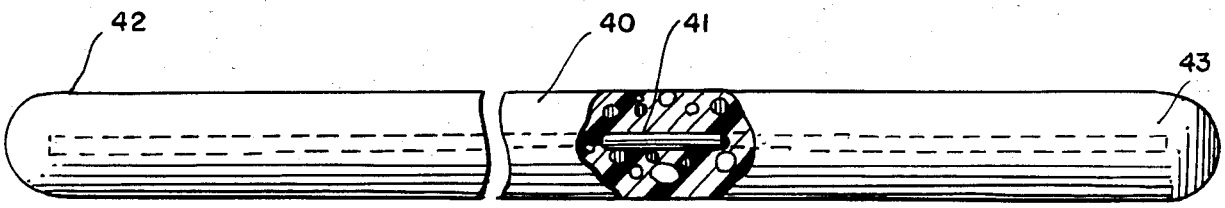
Figure 11:
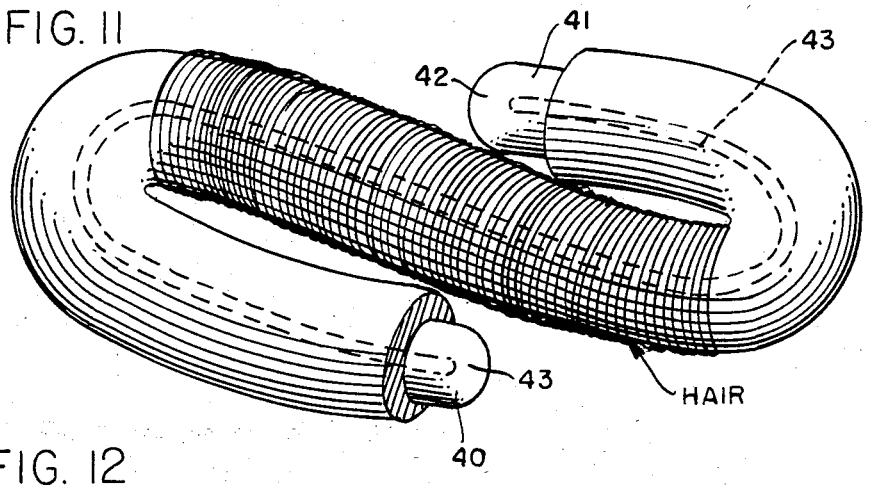
Figure 12:
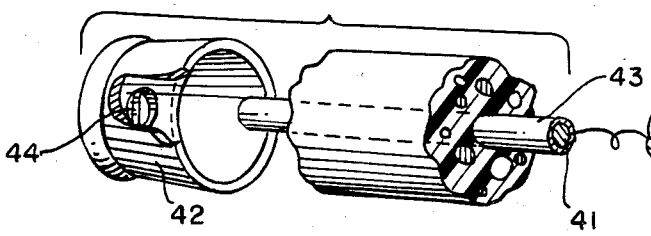
Figure 13:
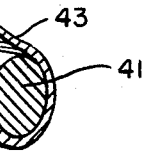
Figure 14:
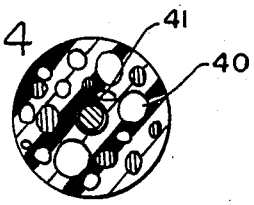
Figure 15:
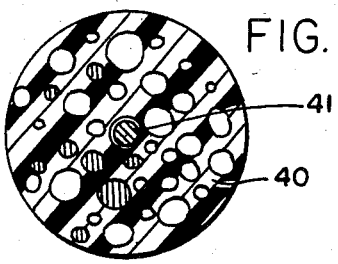

FIGS. 10–15 illustrate a still further embodiment, FIGS. 10 and 11 being perspective views of the complete hair curler, and FIG. 10 being partially broken away to show the internal construction. FIG. 13 is an exploded fragmentary perspective view to illustrate the construction of the waving rod, and FIGS. 14 and 15 are transverse sectional views, illustrating the degree of expansion from the dry sponge of FIG. 14 to the wet sponge of FIG. 15.

DETAILED DESCRIPTION

The general construction of the hair waving rods of this invention will first be described. In generic terms, the waving rods include an elongated generally cylindrical water-absorbing sponge body for receiving a strand of hair wrapped therearound. Since the sponge body is soft and flexible, a support means is provided which extends axially through the sponge body. Also provided is a retainer means associated with the outer end portions of the support means for holding the wrapped hair strand around the sponge body. These components, in general, are known and have been previously used for waving hair.

The distinctive feature of the present invention is that the sponge body is capable of a large degree of expansion from a dry to a wet condition. For obtaining the full benefits of the present invention, the sponge body impregnated within waving lotion should be capable of expanding from a dry condition on application of water to increase its volume by at least 50%. The desirable range expansion is from about 50 to 250%. For example, an advantageous range of expansion from dry to wet condition is a volume increase of from 50 to 150%.

Although water-expansible sponge bodies have not heretofore been proposed for use in hair curling devices, synthetic sponges which expand on being wet with water are known, and have been used for other purposes. Such sponges can be formed from polymer foams. Particularly desirable polymers for this purpose are the water-activated polyisocyanate terminated polyethers. For example, isocyanate capped polyoxyethylene polyols are available from several commercial sources, which can be formed into hydrophilic water-absorbing sponge bodies. In general, the prepolymers should contain sufficient polyoxyethylene groups to provide hydrophilicity. For example, foamable hydrophilic prepolymers of this kind can be prepared from toluene diisocyanate and polyoxyethylene polyols. Such prepolymers are available under the trademark name "HYPOL" from the Organic Chemicals Division of W. R. Grace & Co., Lexington, Mass. They are also available from under the trademark name "Trepol" from Twin Rivers Engineering, East Boothbay, Me. Prepolymers forming hydrophilic foam sponges can also be prepared from methylene phenyl diisocyanate.

The degree of expansion or swell of the foam sponges may vary with the particular formulation and with other ingredients such as surfactants. Preferably, a non-ionic surfactant is utilized in the prepolymer foam mix. Specially desirable commercial prepolymers include Hypol FHP 2000, 2002, and 3000 of W. R. Grace and the Trepol polymers of Twin Rivers. These prepolymers may be used in mixtures or individually. Further information concerning the chemistry of such prepolymers for producing flexible water-absorbent foams is found in U.S. Pat. Nos. 4,137,200, 3,903,232, and 3,369,544. As described in U.S. Pat. No. 3,903,232 with reference to U.S. Pat. No. 3,369,544, expandable sponges may be prepared by first forming the foam bodies, and then compressing the bodies, followed by drying to maintain the sponges in the compressed condition. On the addition of water, the sponges will expand at least to the diameter prior to compression. With the preferred sponges of the present invention, the desired degree of expansion can be obtained without prior compression. However, if desired, compression may be employed either alone, or in combination with inherent expansibility of the sponge body from a dry to a wet condition.

In preferred embodiments, a suitable hair reducing agent is incorporated in the hydrophilic foam sponge. This can be accomplished by impregnating the sponge body after formation with an aqueous solution of the reducing agent, and then drying the sponge body to leave the reducing agent deposited therein. Alternatively, or additionally, the reducing agent can be combined with the mold mix, and incorporated in the sponge as it is initially molded. For example, sodium bisulfite can be used as the reducing agent, either being impregnated in the sponge or molded in situ. For example, in preparing a mold mix from a two part formulation the sodium bisulfite can be combined with the resin prepolymer, or incorporated in both the prepolymer and the aqueous phase. The aqueous phase may also include a non-ionic surfactant at a level of about 0.5 to 1.5% based on the total mix. The aqueous phase and the prepolymer phase are combined, introduced to a mold of the suitable shape to form the cylindrical body, and after the reaction has been completed, the molded body may be dried. During the removal of the water in the drying step, the molded body will shrink, the size reduction corresponding in degree to the size enlargement on rewetting. Consequently, the molded body should be formed oversize.

To provide support for the sponge body, it will usually be preferable to mold it around a support means, such as a relatively rigid rod or tube formed of a suitable plastic, or other support means such as a plastic coated flexible wire. The end portions of the support means may be adapted for attachment to a retainer means or adapted to serve as a retainer.

Suitable formulations and procedure for preparing the foam sponge bodies are illustrated by the following examples.

EXAMPLE I

Two formulas for incorporating a water-soluble hair waving composition or agent in the expandable foam sponge are as follows:

| FORMULATION I | Wt. % |
|---|---|
| Phase I | |
| 1. Hypol FHP 3000 | 19.50 |
| 2. Hypol FHP 2000 | 19.50 |
| 3. Sodium Metabisulfite | 15.00 |
| Phase II | |
| 4. Pluronic L-62 | 0.75 |
| 5. Pluronic P-75 | 0.25 |
| 6. Deionized Water | 38.00 |
| 7. N, N—Dimethyl Urea | 2.00 |
| 8. Sodium Metabisulfite | 5.00 |

| FORMULATION II | Wt. % |
|---|---|
| Phase I | |
| 1. Hypol FHP 3000 | 19.50 |
| 2. Hypol FHP 2002 | 19.50 |
| 3. Sodium Metabisulfite | 15.00 |
| Phase II | |
| 4. Deionized Water | 38.25 |
| 5. N, N—Dimethyl Urea | 2.00 |
| 6. Pluronic L-62 | 0.75 |
| 7. Sodium Metabisulfite | 5.00 |

Hypol FHP 3000, 2000, and 2002 are foamable hydrophilic prepolymers of the Organic Chemical Division of W. R. Grace & Co., Lexington, Mass., comprising polyisocyanate terminated polyethers formed from toluene diisocyanate and polyoxyethylene. Prepolymers have molecular weights in the range of about 1,300–1,400 and contain about 2.3 to 2.4 -NCOs/mole. Pluronic L-62 and P-75 are non-ionic surfactants of BASF Wyandotte , Parsippany, N.J.

The ingredients of Formulation I and II can be combined as follows:

Step 1. Mix ingredients in Phase II, i.e., 4, 5, 6, 7 and 8 under a Nitrogen blanket. When the solution is clear, stop mixing.

Step 2. Mix ingredients 1 and 2 together using slow speed. When mixture appears homogenous, add 3 slowly, mix thoroughly.

Step 3. Add Phase II to Phase I. Mix well then place foam in a suitable mold.

The formulations may be prepared and molded at room temperature, or at a slightly elevated temperature. Temperatures of 85°–110° F. are suitable. The molding should be carried out immediately after mixing the aqueous and polymer phases. Preferably, the molded sponge bodies are formed with minimal surface skin. Warming the mold gives a more open and thinner skin, and combinations of special mold surfaces (e.g. parafin wax, silicon rubber, etc.) with warm molds (110°–130° F.) gives very little skin. However, the presence of skin is not highly objectionable. The skin is porous, and water and the solubilized waving agent will pass therethrough.

The foam sponges prepared according to Formulations I and II after molding will shrink during drying and therefore should be molded oversize. The expected volumetric enlargement in cylindrical forms adapted for use in waving rods will be of the order 50 to 150%. For example, if the cylindrical sponge body has a volume of 10 cc in the dry state, on wetting the sponge body, the average volume will increase to about 15 to 25 cc. Preferably, the form sponges have a density in the range from about 0.15 to 0.3 gms/cc, which has been found to be an effective density for squeezing out the waving lotion into the hair. EXAMPLE II Expandable sponge bodies for use in the hair waving rods of this invention can be formed without the incorporation of a hair reducing agent according to the following three formulas.

| FORMULATION I | Wt. % |
|---|---|
| Phase I | |
| 1. Trepol Polymer | 50.00 |
| Phase II | |
| 2. Miranol BT | 11.15 |
| 3. Tween 20 | 3.72 |
| 4. Sandopan LS-24 | 0.885 |
| 5. Citric Acid 50% | 0.425 |
| 6. Pluronic F-88 | 0.495 |
| 7. Deionized Water | 33.325 |

| FORMULATION II | Wt. % |
|---|---|
| Phase I | |
| 1. Trepol Polymer | 40.50 |
| 2. Hypol FHP 2002 | 9.50 |
| Phase II | |
| 3. Miranol BT | 5.00 |
| 4. Tween 20 | 5.00 |
| 5. Pluronic F-88 | 1.00 |
| 6. Pluronic L-62 | 0.35 |
| 7. Citric Acid 50% | 0.535 |
| 8. Deionized Water | 38.115 |

| FORMULATION III | Wt. % |
|---|---|
| Phase I | |
| 1. Hypol FHP 3000 | 31.0 |
| 2. Hypol FHP 2002 | 31.0 |
| Phase II | |
| 3. Sandopan LS-24 | 0.50 |
| 4. Pluronic F-88 | 0.50 |
| 5. Pluronic L-62 | 0.50 |
| 6. Deionized Water | 36.50 |

In the foregoing formulas the chemical identification and the manufacturer of the ingredients listed by tradename are as follows:

| Ingredient | Chemical Identification | Supplier |
|---|---|---|
| Trepol Polymer | Hydrophilic Polyurethane Prepolymer | Twin River Engineering Rte. 96, Box 193 East Boothbay, Main 04544 |
| Miranol BT | Lauroamphocarboxyglycinate (and) Sodium Trideceth Sulfate | The Miranol Chemical Company, Inc. P.O. Box 411 68 Culver Road Dayton, New Jersey 08810 |
| Tween 20 | Polysorbate 20 | ICI Americas Wilmington, Delaware 19897 |
| Sandopan LS-24 | Sodium Laureth - 13 Carboxylate | Sandoz Colors and Chemicals, Inc. Charlotte, NC 28205 |
| Hypol FHP-2002 | Hydrophilic Polyurethane | W.R. Grace Lexington, Mass. 02173 |
| Pluronic F-88 | Poloxamer 238 | BASF - Wyandotte 100 Cherry Hill Road Parsippang, NJ 07054 |
| Pluronic L-62 | Poloxamer 182 | BASF - Wyandotte 100 Cherry Hill Road Parsippang, NY 07054 |

For example, Formulation I can be combined as follows:

Step 1. Mix ingredients 2, 3, 4, 6, and 7 of Phase II at 60° C.

Step 2. Cool mixture to 50° C. and add 5. Continue cooling to 21° C.

Step 3. While Phase II is cooling to 23° C. begin heating Phase I to 38° C.

Step 4. After both phases have reached temperature begin mixing Phase I and Phase II.

Once the two Phases are mixed they can be forced out into a mold. The mold is then clamped shut and a lid placed over the top. This forces out the excess foam and forces the foam into the voids. After five minutes the mold can be taken apart and the rod shaped foam removed. Another possible method of forming the rod shaped foam is as follows:

Mix Phase I and Phase II and pour the forming form into a length of tubing. As the foam forms cap both ends with caps, one of which has a small hole in it to allow gas to escape. After five minutes, the caps are removed and the rod shaped foam removed.

The preformed rollers can be used as components of self-tensioning hair waving rods without impregnation, the waving rods being used with standard waving solution, applied as a solution to the hair wrapped on the sponge bodies. Preferably, however, the preformed rollers are impregnated with the reducing agents. Suitable impregnation formulas are as follows:

FORMULA I

| Ingredients | Wt. % |
|---|---|
| 1. Deionized Water | 56.36 |
| 2. Monoethanolamine | 5.64 |
| 3. N, N—Dimethyl Urea | 3.00 |
| 4. Sodium Metabisulfite | 35.00 |

FORMULA II

| Ingredients | Wt. % |
|---|---|
| 1. Magnesium Thioglycolate 40.96% | 10.00 |
| 2. Potassium Thioglycolate 56.77% | 8.00 |
| 3. Potassium Hydroxide (20% aq.) | 8.15 |
| 4. Monethanolamine | 1.81 |
| 5. Brij 35 | 0.25 |
| 6. Isopropanol Alcohol | 0.25 |
| 7. Sodium EDTA | 0.25 |
| 8. Deionized Water | 71.29 |

In the foregoing Formulas I and II, Brij 35 is Laureth 23, ICI Americas, Wilmington, Del.

The rollers may be impregnated with the solutions of Formulas I and II as follows:

Step 1. The preformed roller is dried down completely and then placed in the saturated solution and allowed to absorb the solution for 30 minutes.

Step 2. The roller is then removed from solution and placed in a vacuum desiccator with Drierite, or the rollers can be dried for 24 hours in a vacuum oven between 100°–110° F. The dried rollers are then removed and placed under Nitrogen for use later.

With reference to the foregoing examples, the sponge bodies may be formed in a true cylindrical shape, or a generally cylindrical shape, such as one in which the outer surface of the sponge body has a slightly concave configuration to assist in receiving the hair strand. Typical diameters of the sponge bodies after forming, impregnating, and drying are from 0.30 inches to 0.40 inches. On rewetting the diameters will increase from about 25 to 75%. It will be understood that larger or smaller diameters can be used for special waving purposes.

Self-tensioning hair waving rods formed in accordance with the present invention, and incorporating the expandable sponge bodies can be used in a similar manner to presently employ waving rods. A generally suitable procedure is as follows:

The hair is shampooed then towel dried. The slightly wet hair is then rolled with the impreganted expansible roller. The hair is then wetted with water. After a five minute delay it is wetted again. A plastic cap is then placed over the head and left on for 45–60 minutes. After which the hair is rinsed with warm water until all material is rinsed out. The hair is then blotted dry and neutralized with a suitable oxidizing agent. This is left on the hair for 10 minutes and then rinsed completely out. The hair is then unrolled and either dried or set for style.

Figure 1:
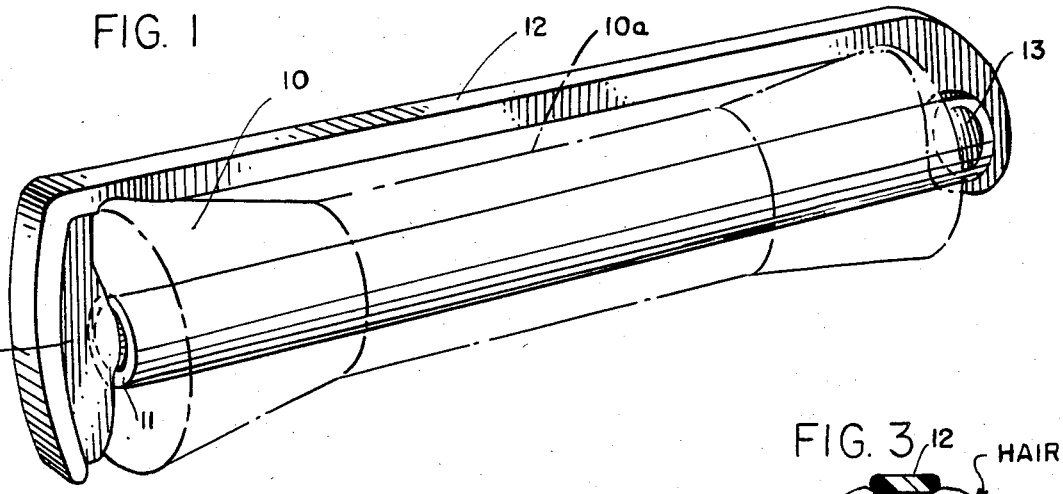
Figure 3:
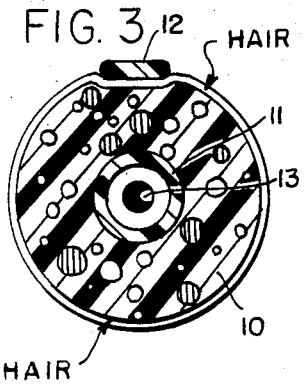
Figure 2:
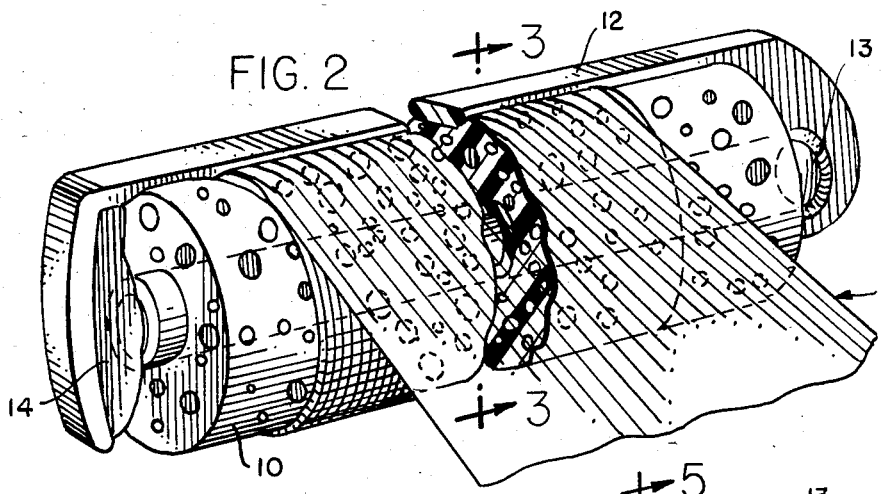
Figure 5:
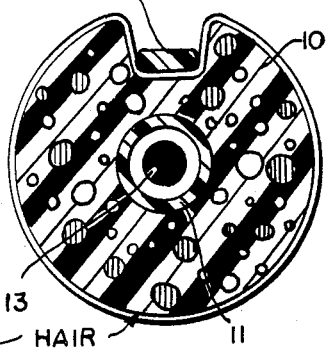
Figure 4:
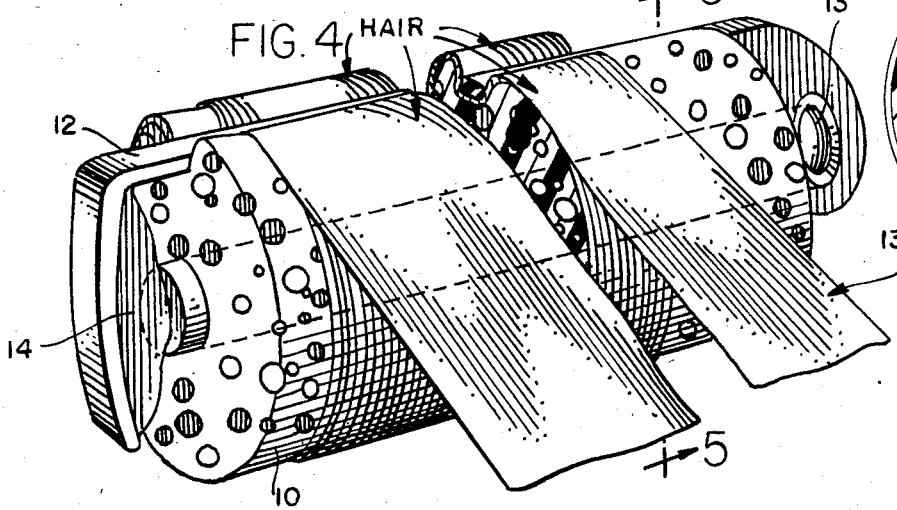

The accompanying drawings illustrate the wide variety of designs for hair waving rods which may be used with the expandable sponge bodies of the present invention. One illustrative embodiment is shown in FIGS. 1–5. The sponge body 10 is of generally cylindrical configuration, but has a slightly concave outer surface to provide a recessed central portion 10*a*. The sponge body has been molded on a supporting tube 11 of a relatively rigid plastic. A retainer clip 12 is hingidly connected at 13 to the support tube 11 and is provided with a catch member 14 at its other end which latches with the adjacent end of the tube 11. Thus, the clip may be opened and a strand of hair started on the recessed central portion 10*a*. As the wrapping continues, as illustrated in FIG. 2, the wrap will build up to a cylindrical shape filling the recessed portion 10*a*. After the wrap is complete, the clip is closed, as shown in FIG. 2. Preferably, as previously described, the sponge body 10 contains a water-soluble waving composition. When water is applied to the wrap, the sponge body begins to enlarge, as illustrated in FIG. 2, and also shown in the cross-sectional view of FIG. 3. The expansion proceeds rapidly, until the size increases to that shown in FIG. 4 and further illustrated in the cross-sectional view of FIG. 5. In that condition, the wrapped hair strand has been tightened around the foam body 10 and has been brought into close proximity with the outer surface of the body. The solubilized waving composition is then readily transferred from the sponge body to the wrapped strand of hair.

In FIG. 6, there is shown a modification of the curler rod as in the preceding figures. The sponge body 10 is of similar shape having a recessed central portion 10*a*. It is mounted on a solid plastic pin 11 the retainer means includes an elastic band 12 having an enlargement 12*a* at one end which is received in a socket 13 in one end of the rod 11. The other end of the pin 11 provides a recessed 14 into which is received as a press fit the extension 15 of 16, which in turn in connected to the elastic band 12 as indicated at 17. In using the waving rod of FIG. 6, the cap 16 will be detached and the elastic band 12 swung out of the way. The hair strand may then be wound on the foam body as indicated by the arrows in FIG. 6.

A further embodiment is illustrated in FIGS. 7–9. The sponge body 30 is supported on an axially extending central pin 31. The retainer is in the form of a spring clip member 32 which can be flexed and slipped over the body 30. In use, the clip is removed, and the strand of hair is wrapped on the foam body. The clip is then reapplied to hold the wrap in place. This is illustrated more clearly in FIG. 9. Then water is applied to expand the foam body, tightening the hair, and drawing it into close contact with the outer surface of the foam body, as illustrated in FIG. 8.

A still further embodiment is illustrated in FIGS. 10 to 15. This consists of an elongated cylindrical foam body supported on an axially extending plastic coated copper wire. As shown in FIG. 10, the foam body 40 has its central portion broken away to reveal the plastic coated copper wire 41. The wire and form body are made longer than needed for a hair wrap. The outer ends are closed by cap members 42, 43, which may be plastic caps attached to the projecting ends of the wire 41. These details of construction are shown more clearly in FIG. 3. The coating on the wire 41 being indicated by the number 43 and the socket 44 being shown within the cap 42.

In use, the hair is wrapped on the central portion of the foam body with end portions extending outwardly beyond the hair wrap. One end is then kinked upward and the other end kinked downward to form an "S" shape that serves as a tight retainer, as illustrated in FIG. 11. This configuration will also allow for deposition of waving lotion onto the outer layers of the hair. Water is then applied to the hair wrap in the manner previously described. An approximation of the size enlargement is shown with reference to FIGS. 14 and 15, the dry cross-section being indicated in FIG. 14 and the enlarged cross-section after wetting being shown in FIG. 15.

We claim:

1. A self-tensioning hair waving rod adapted for home permanent use, comprising an elongated generally cylindrical water-absorbing sponge body in substantially dry condition for receiving a strand of hair wrapped therearound, support means extending axially through said sponge body, and retainer means associated with the outer end portions of said support means for holding the wrapped hair strand around the sponge body, said sponge body being formed of a hydrophilic polymer which expands from dry condition on application of water to increase its volume by 50 to 250%, whereby the wrapped strand is tightened and drawn into close proximity to the outer surface of said sponge body.

2. The hair waving rod of claim 1 in which said sponge contains water-soluble hair waving agent for transfer to the wrapped hair strand, whereby the water-wet expanded condition of said sponge body promotes the effective transfer of the waving agent to the hair.

3. The hair waving rod of claim 1 in which said sponge body is formed from an isocyanate capped polyoxyethylene polyol containing sufficient polyoxyethylene groups to provide hydrophilicity.

4. A self-tensioning hair waving rod adapted for home permanent use, comprising an elongated generally cylindrical water-absorbing sponge body in substantially dry condition for receiving a strand of hair wrapped therearound, support means extending axially through said sponge body, and retainer means associated with the outer end portions of said support means for holding the wrapped hair strand around the sponge body, said sponge body containing a dry water-soluble air waving agent for transfer to the wrapped hair strand, said sponge body being formed from a toluene diisocyanate terminated prepolymer containing sufficient polyoxyethylene groups to provide hydrophilicity and having a density of from about 0.15 to 0.3 gms/cc, said sponge body expanding from said dry condition on application of water to increase its volume from 50 to 150%, whereby the wrapped strand is tightened and drawn into close proximity to the outer surface of said sponge body and the waving agent is effectively transferred to the hair.

5. The method of waving hair wherein a hair waving rod is employed which comprises an elongaged, generally cylindrical water-absorbing sponge body in substantially dry condition, support means extending axially through the sponge body and retainer means associated with the outer end portions of said support means, said sponge body being formed of a hydrophilic polymer which expands from said dry condition on application of water to increase its volume by 50 to 250%, comprising the steps of wrapping a strand of hair around said sponge body, securing the wrapped strand on said body said retainer means, and applying an aqueous liquid containing water-soluble waving composition to the wrapped hair strand, said aqueous liquid expanding said sponge body, the wrapped strand being thereby tightened and drawn into close proximity to the outer surface of the sponge body as the waving agent acts on the wrapped hair strand.

6. The method of waving hair wherein a hair waving rod is employed which comprises an elongated generally cylindrical water-absorbing sponge body in substantially dry condition, support means extending axially through the sponge body and retainer means associated with the outer end portions of said support means, said sponge body being formed of a hydrophilic polymer which expands from a substantially dry condition on application of water to increase its volume by 50 to 250%, said sponge containing a water-soluble hair waving composition, comprising the steps of wrapping a strand of hair around said sponge body, securing the wrapped strand on said body by said retainer means, and applying water to the wrapped hair strand, said water expanding the sponge body and solubilizing said waving composition therein for transfer to said hair strand as it is tightened and drawn into close proximity to the outer surface of the sponge body.

* * * * *

UNITED STATES PATENT AND TRADEMARK OFFICE

CERTIFICATE OF CORRECTION

PATENT NO. : 4,605,021

DATED : August 12, 1986

INVENTOR(S) : Homer J. Hodson, Glenn A. Shurney and Eric E. Hartman

It is certified that error appears in the above-identified patent and that said Letters Patent is hereby corrected as shown below:

| | |
|---|---|
| Column 2, line 19 | Correct the spelling of "waver" to -- wave -- |
| Column 5, line 24 | Correct "form" to -- foam -- |
| Column 6, last table therein | First item under Supplier, correct the spelling of "Main" to -- Maine -- |
| Same table, last two items under Supplier | Correct the spelling of "Parsippang" to -- Parsippany -- |
| Column 7, line 3 | Change "form" to -- foam -- |
| Column 8, line 45 | Delete "in" (both appearances) and substitute -- is -- and; |
| Column 8, line 67 | Change "form" to -- foam -- |
| Column 10, line 3 | Correct "air" to -- hair -- |

Signed and Sealed this

Tenth Day of March, 1987

*Attest:*

*Attesting Officer*

DONALD J. QUIGG

*Commissioner of Patents and Trademarks*